US011603246B2

(12) United States Patent
Mavrianos

(10) Patent No.: US 11,603,246 B2
(45) Date of Patent: Mar. 14, 2023

(54) BEVERAGE CONTAINER WITH STRAW STORAGE COMPARTMENT

(71) Applicant: Hogg Outfitters, LLC, Edison, NJ (US)

(72) Inventor: Irene Mavrianos, Raritan, NJ (US)

(73) Assignee: Hogg Outfitters, LLC, Edison, NJ (US)

( * ) Notice: Subject to any disclaimer, the term of this patent is extended or adjusted under 35 U.S.C. 154(b) by 0 days.

(21) Appl. No.: 17/520,880

(22) Filed: Nov. 8, 2021

(65) Prior Publication Data

US 2022/0306367 A1 Sep. 29, 2022

Related U.S. Application Data

(63) Continuation of application No. 16/803,744, filed on Feb. 27, 2020, now Pat. No. 11,167,905.

(51) Int. Cl.
*B65D 77/28* (2006.01)
*B65D 85/72* (2006.01)
(Continued)

(52) U.S. Cl.
CPC ..... *B65D 77/283* (2013.01); *B65D 25/04* (2013.01); *B65D 47/06* (2013.01); *B65D 51/28* (2013.01);
(Continued)

(58) Field of Classification Search
CPC ..... B65D 77/283; B65D 47/06; B65D 47/04; B65D 85/72; B65D 1/40; B65D 25/04;
(Continued)

(56) References Cited

U.S. PATENT DOCUMENTS 1,209,998 A 12/1916 Pinckert
3,281,024 A 10/1966 Henchert
(Continued)

FOREIGN PATENT DOCUMENTS

WO 2003004381 1/2003

OTHER PUBLICATIONS https://hoggoutfitters.com/collections/tumblers/products/20oz-skinny-strawbler-tumbler, Mar. 8, 2021 (Yean 2021), 1 page.
(Continued)

*Primary Examiner* — Robert J Hicks
(74) *Attorney, Agent, or Firm* — Sheppard Mullin Richter & Hampton LLP

(57) ABSTRACT

A beverage container having a straw storage compartment in the base of the container for a self-contained straw is described herein. The beverage container may comprise a container body having a beverage holding chamber and a straw storage compartment configured to enable storage of a removable drinking straw. A removable bottom closure component may be provided for opening and closing the straw storage compartment. The straw-holding structure may be attached to a wall defining the straw storage compartment or attached to an inner portion of the removable bottom closure component, such that when the removable bottom closure component is positioned to close the straw storage compartment, the straw-holding structure is located within the straw storage compartment. When the removable bottom closure component is fully engaged with the container body at an open lower end of the container body, the removable drinking straw may be entirely enclosed within the beverage container.

20 Claims, 8 Drawing Sheets

(51) Int. Cl.
*B65D 51/28* (2006.01)
*B65D 25/04* (2006.01)
*B65D 47/06* (2006.01)

(52) U.S. Cl.
CPC ..... *B65D 85/72* (2013.01); *B65D 2547/06* (2013.01)

(58) Field of Classification Search
CPC ..... B65D 25/02; B65D 25/22; B65D 25/24; B65D 51/28; B65D 41/04; A47G 21/28; A47G 19/2272
USPC ..... 220/705, 707, 630, 628, 625, 270, 271, 220/272, 906; D9/443
See application file for complete search history.

(56) References Cited

U.S. PATENT DOCUMENTS

| | | | |
|---|---|---|---|
| D301,007 | S | 5/1989 | Laski |
| 5,054,631 | A | 10/1991 | Robbins, III |
| D333,066 | S | 2/1993 | Kimpson |
| D348,084 | S | 6/1994 | Adell |
| D375,870 | S | 11/1996 | Stonehouse |
| D376,071 | S | 12/1996 | Ballin |
| D408,685 | S | 4/1999 | Lage |
| 6,244,460 | B1 | 6/2001 | Winberg |
| D470,007 | S | 2/2003 | D'Alessio |
| D484,747 | S | 1/2004 | McMahon, III |
| D515,366 | S | 2/2006 | Jackson |
| D528,167 | S | 9/2006 | Tremain |
| D528,865 | S | 9/2006 | Barton |
| D548,016 | S | 8/2007 | Jackson |
| D569,183 | S | 5/2008 | Blake |
| D569,188 | S | 5/2008 | Tornqvist |
| D571,610 | S | 6/2008 | Bodum |
| D621,658 | S | 8/2010 | Rice |
| 7,841,485 | B1 | 11/2010 | Rodriguez |
| D628,442 | S | 12/2010 | Lundberg |
| D648,599 | S | 11/2011 | Watanabe |
| D689,732 | S | 9/2013 | Hollinger |
| D703,008 | S | 4/2014 | Wampold |
| D799,268 | S | 10/2017 | Gschwandtl |
| D809,874 | S | 2/2018 | Thomason |
| D827,379 | S | 9/2018 | Mulhauser |
| D862,172 | S | 10/2019 | Lovegrove |
| D871,143 | S | 12/2019 | Hannigan |
| D871,148 | S | 12/2019 | Gordon |
| D874,224 | S | 2/2020 | Omdahl, II |
| D877,561 | S | 3/2020 | Matsumoto |
| D877,736 | S | 3/2020 | Ouyang |
| D885,134 | S | 5/2020 | Bodum |
| D941,094 | S | 1/2022 | Edge |
| 2006/0180593 | A1 | 8/2006 | White |
| 2009/0080180 | A1 | 3/2009 | Bertken |
| 2010/0288781 | A1 | 11/2010 | Kelley |
| 2012/0061409 | A1 | 3/2012 | Fioritto |
| 2017/0273484 | A1 | 9/2017 | Spivey |

OTHER PUBLICATIONS https://hoggoutfitters.com/collections/tumblers/products/30oz-strawbler-tumbler, no date available, website visited on May 2, 2022 (Year: 2022), 1 page.
https://us.shein.com/1pc-Wave-Edge-Coaster-DIY-Epoxy-Mold-p-1872787-cat-2504.html , Dec. 25, 2020 (Year: 2020), 1 page.
https://www.amazon.com/Gadjit-Adapter-Adjustable-Tumbler-diameters/dp/B084G9DD6C, Feb. 3, 2020 (Year: 2020), 3 pages.
https://www.amazon.com/Thirstystone-NCIL026-Industrial-Galvanized-Coasters/dp/B01GTVFHDS/ref=as_li_ss_tl?ie=UTFS&linkCode=sl1&tag=deskdeck-20linkId=c0aa1ct600e742b4360beb8a29c8994a, Jun. 9, 2016 (Year: 2016), 5 pages.
https://www.eagleasap.com/product-page/round-pointed-edge-absorbent-stone-coaster, Oct. 19, 2020 (Year: 2020), 1 page.
https://www.turbosquid.com/FullPreview/Index.cfm/ID/652799, Feb. 2, 2012 (year: 2012), 1 page.

BEVERAGE CONTAINER WITH STRAW STORAGE COMPARTMENT

CROSS-REFERENCE TO RELATED APPLICATIONS

This application is a continuation of U.S. patent application Ser. No. 16/803,744, filed Feb. 27, 2020, entitled "BEVERAGE CONTAINER WITH STRAW STORAGE COMPARTMENT" (which issued as U.S. Pat. No. 11,167,905 on Nov. 9, 2021), which is hereby incorporated herein by reference in its entirety.

FIELD OF THE INVENTION

The present invention relates to a beverage container having a storage compartment with a straw-holding structure in the base of the container.

BACKGROUND OF THE INVENTION

Each day, hundreds of millions of disposable plastic straws are used and discarded. In the past few years, awareness of this wasteful practice and initiatives to curb the use of disposable straws have greatly increased. Notwithstanding this growing movement, many individuals still prefer using a drinking straw to drinking a beverage without one. However, many establishments serving beverages do not provide reusable drinking straws due to the fact that reusable drinking straws are more expensive than disposable drinking straws and must be cleaned and maintained in a sanitary condition similar to utensils. Additionally, individuals may be reluctant to carry and/or forget to bring with them a reusable drinking straw in addition to other items they may be accustomed to carrying with them. While beverage containers that include a reusable drinking straw exist, the drinking straw is typically sticking out of the beverage container, exposing the straw to the environment and potentially unsanitary conditions, while also making the beverage container more difficult to store and transport. Prior beverage containers suffer from these and other drawbacks.

SUMMARY OF THE INVENTION

The present invention is directed to a beverage container having a first portion that defines a beverage holding chamber and a second portion that defines a straw storage compartment configured to enable storage of a removable drinking straw. A straw-holding structure may be located within the straw storage compartment. A removable bottom closure component may be provided for opening and closing the straw storage compartment. The straw-holding structure may be attached to a wall defining the straw storage compartment or attached to an inner portion of the removable bottom closure component, such that when the removable bottom closure component is positioned to close the straw storage compartment, the straw-holding structure is located within the straw storage compartment.

The beverage container may have a container body comprising an outer wall that substantially defines an outer wall of the beverage holding chamber, an outer wall of the straw storage compartment, and at least one divider wall (or internal divider) located within the beverage container that physically separates the beverage holding chamber from the straw storage compartment. The beverage holding chamber may comprise an open upper end and a closed lower end. The straw storage compartment may comprise a closed upper end and an open lower end. The internal divider may define the closed lower end of the beverage holding chamber and the closed upper end of the straw storage compartment. The open upper end of the beverage holding chamber may define an upper opening for receiving a lid. The open lower end of the straw storage compartment may define a lower opening for receiving the removable bottom closure component. The removable bottom closure component may be configured to engage the open lower end of the container body and temporarily enclose the straw storage compartment. When the removable bottom closure component is fully engaged with the container body at the open lower end of the container body, the removable drinking straw may be entirely enclosed within the beverage container.

Additional features, advantages, and embodiments of the disclosure may be set forth or apparent from consideration of the following attached detailed description and drawings. Moreover, it is to be understood that both the foregoing summary of the disclosure and the following attached detailed description are exemplary and intended to provide further explanation without limiting the scope of the disclosure as claimed.

BRIEF DESCRIPTION OF THE DRAWINGS

The drawings are provided for purposes of illustration only and merely depict typical or example implementations. These drawings are provided to facilitate the reader's understanding and shall not be considered limiting of the breadth, scope, or applicability of the disclosure. For clarity and ease of illustration, these drawings are not necessarily drawn to scale.

DETAILED DESCRIPTION OF THE INVENTION

Figure 1:
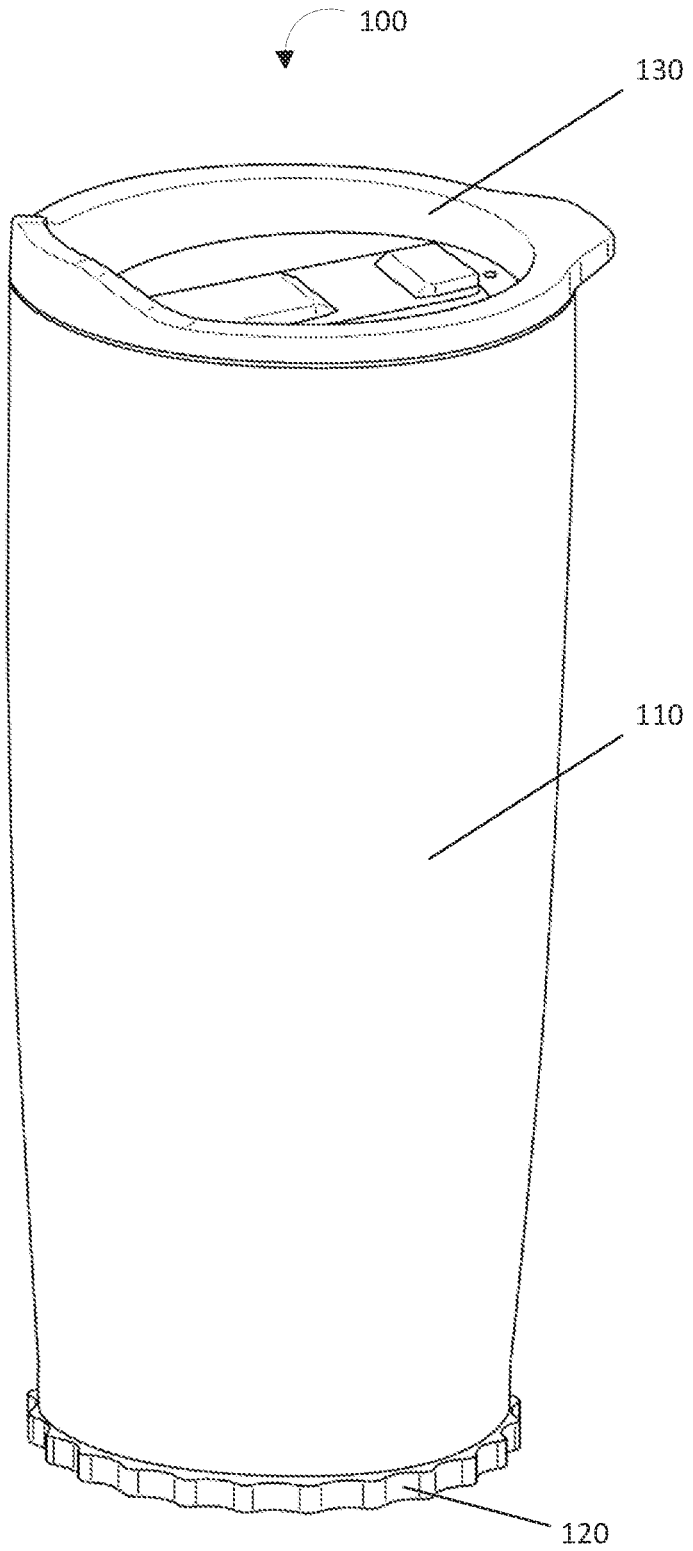
FIG. 1 shows a perspective view of a beverage container with a straw storage compartment, according to an implementation of the invention.

The invention described herein relates to a beverage container with a straw storage compartment with a straw-holding structure in the base of the container for a self-contained straw. In various embodiments, the beverage container may comprise a first portion that defines a beverage holding chamber and a second portion that defines a straw storage compartment configured to enable storage of a removable drinking straw. A straw-holding structure may be located within the straw storage compartment. A removable bottom closure component may be provided for opening and closing the straw storage compartment. The straw-holding structure may be attached to a wall defining the straw storage compartment or attached to an inner portion of the removable bottom closure component, such that when the removable bottom closure component is positioned to close the straw storage compartment, the straw-holding structure is located within the straw storage compartment.

The embodiments of the invention described herein and the various features and advantageous details thereof are explained more fully with reference to the non-limiting embodiments and examples that are described and/or illustrated in the accompanying drawings and detailed in the following attached description. It should be noted that the features illustrated in the drawings are not necessarily drawn to scale, and features of one embodiment may be employed with other embodiments as the skilled artisan would recognize, even if not explicitly stated herein. Descriptions of well-known components may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure, which is defined solely by the appended claims and applicable law. Moreover, it is noted that like reference numerals represent similar parts throughout the several views of the drawings.

Figure 2:
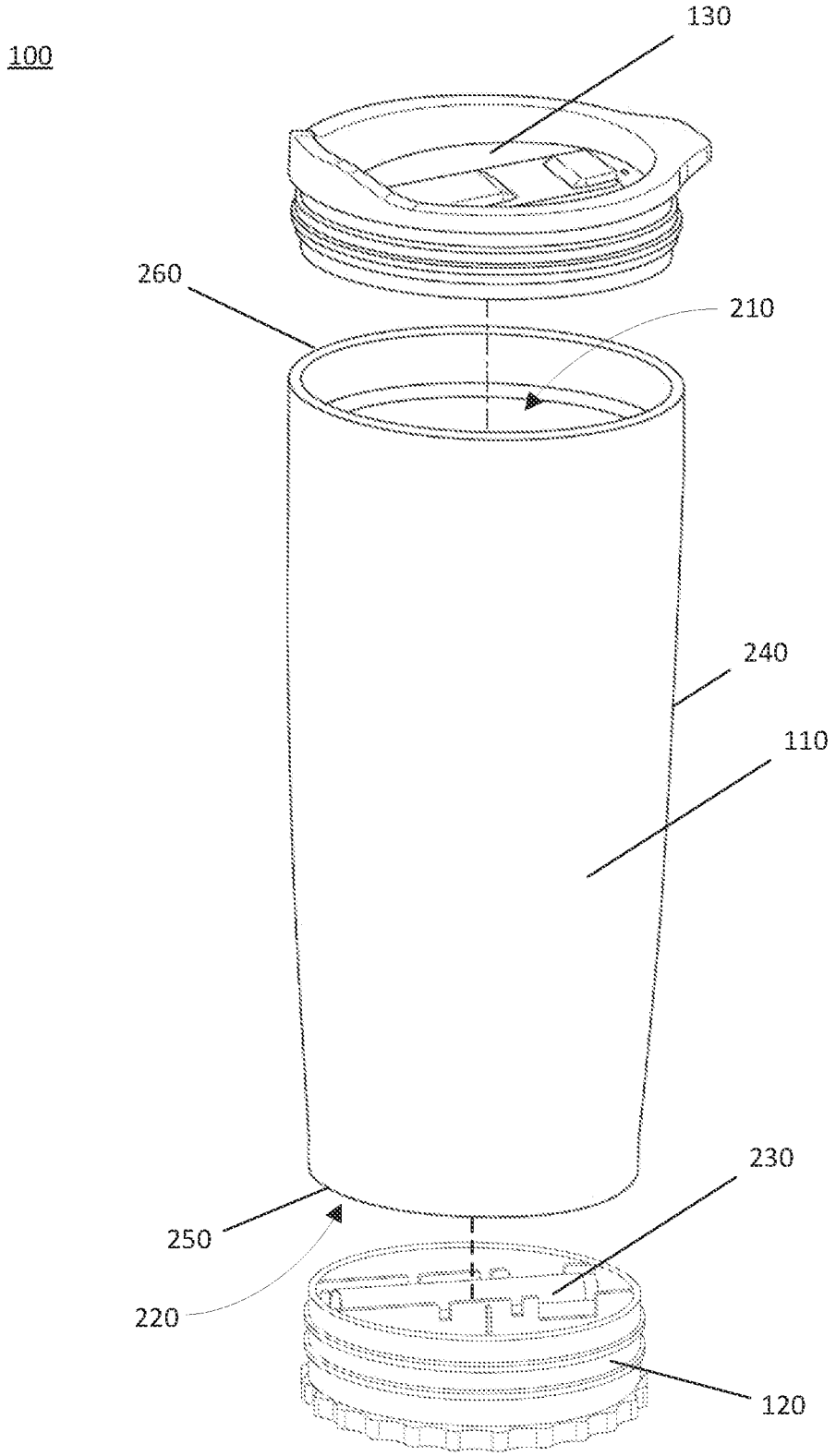
FIG. 2 shows an exploded perspective view of a beverage container with a straw storage compartment, according to an implementation of the invention.

FIG. 1 shows a perspective view of a beverage container 100 with a storage compartment for a self-contained straw, according to an implementation of the invention. In various embodiments, beverage container 100 may comprise an insulated reusable drinking vessel, such as a bottle, mug, tumbler, or other beverage container. FIG. 2 shows an exploded perspective view of beverage container 100, according to an implementation of the invention. Referring to FIG. 1 and FIG. 2 concurrently, beverage container 100 may comprise at least a container body 110 and a removable bottom closure component 120. In various embodiments, beverage container 100 may further comprise a lid 130 and/or one or more other components. Container body 110 may comprise at least a first portion and a second portion. In various embodiments, the first portion may define a beverage holding chamber 210, and the second portion may define a straw storage compartment 220 configured to enable storage of a removable drinking straw. Removable bottom closure component 120 may be provided for opening and closing straw storage compartment 220. When removable bottom closure component 120 is affixed to container body 110, straw storage compartment 220 of container body 110 and removable bottom closure component 120 may form a chamber configured to store a removable drinking straw 230.

Container body 110 may comprise an outer container wall 240 that substantially defines an outer wall of beverage holding chamber 210, an outer wall of straw storage compartment 220, and at least one divider wall (or internal divider) located within container body 110 that physically separates beverage holding chamber 210 from straw storage compartment 220. Straw storage compartment 220 may comprise a closed upper end and an open lower end (i.e., open lower end 250). Open lower end 250 of straw storage compartment 220 may define a lower opening of container body 110 for receiving removable bottom closure component 120. Beverage holding chamber 210 of container body 110 may comprise an open upper end (i.e., open upper end 260) and a closed lower end. Open upper end 260 of beverage holding chamber 210 may define an upper opening of container body 110 for receiving lid 130. The at least one divider wall (or internal divider) may define the closed lower end of beverage holding chamber 210 and the closed upper end of straw storage compartment 220. Removable bottom closure component 120 may be configured to engage container body 110 via open lower end 250 and temporarily enclose straw storage compartment 220. When the removable bottom closure component is fully engaged with the container body at the open lower end of the container body, removable drinking straw 230 may be entirely enclosed within beverage container 100.

In various embodiments, straw storage compartment 220 may include a straw holder and/or other structure configured to retain a straw within straw storage compartment 220. In various embodiments, the straw-holding structure may comprise one or more channels configured to receive a straw and hold the straw in a relatively fixed position within straw storage compartment 220. In some embodiments, the one or more channels may be configured to receive and hold a straw with one or more bends. In some embodiments, the one or more channels may include one or more protrusions configured to retain a straw within the channel. In some embodiments, the straw-holding structure may be attached to a wall defining straw storage compartment 220 or attached to an inner portion of the removable bottom closure component 120, such that when removable bottom closure component 120 is positioned to close straw storage compartment 220, the straw-holding structure is located within the straw storage compartment 220.

Figure 4:
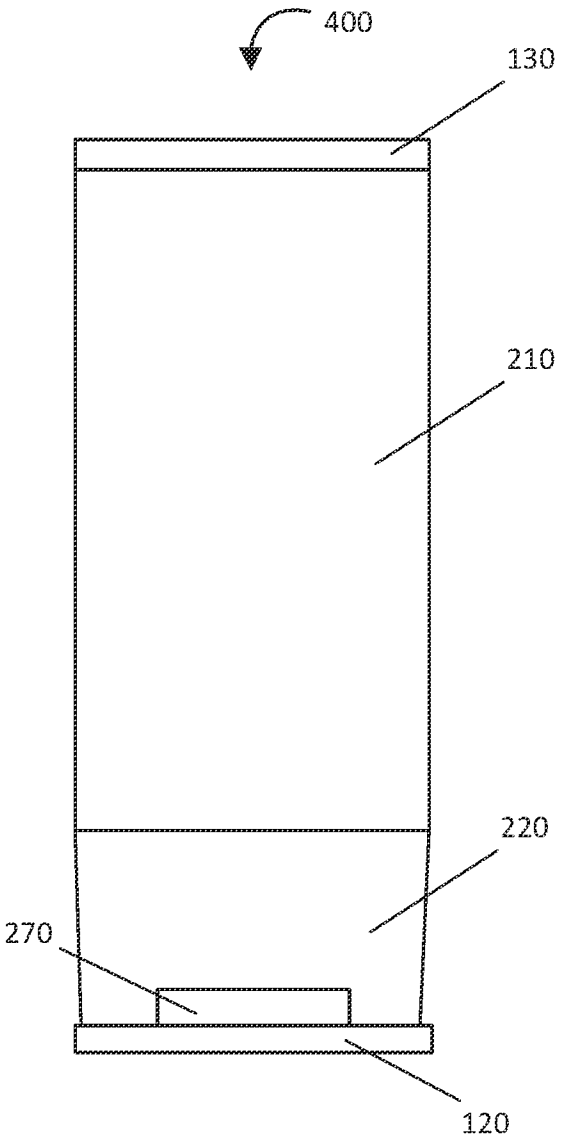
FIG. 4 depicts an example of a beverage container with a straw storage compartment that includes a straw-holding structure within the removable bottom closure, according to an implementation of the invention.
Figure 3:
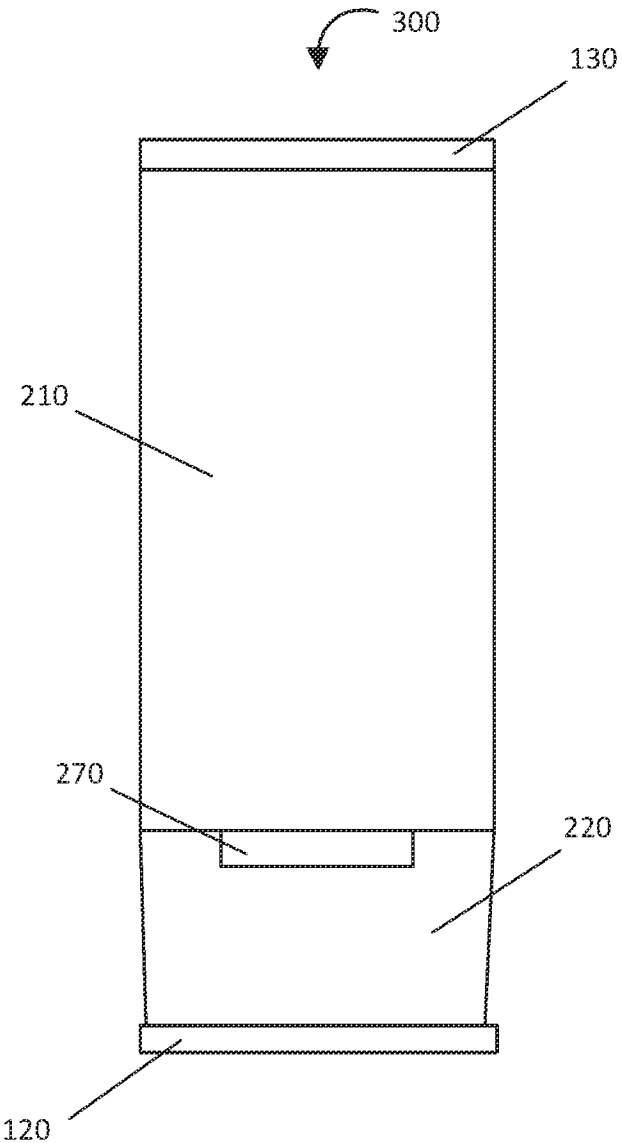
FIG. 3 depicts an example of a beverage container with a straw storage compartment that includes a straw-holding structure within the container body, according to an implementation of the invention.

For example, FIG. 3 and FIG. 4 depict example embodiments of beverage container 100 with a straw storage compartment 220 that includes a straw-holding structure 270. In FIG. 3, example embodiment 300 of beverage container 100 is depicted comprising a container body 110, a removable bottom closure component 120, and a lid 130. Container body 110 of example embodiment 300 comprises a beverage holding chamber 210 and a straw storage compartment 220. In example embodiment 300, straw-holding structure 270 is attached to a wall defining straw storage compartment 220. In FIG. 4, example embodiment 400 of beverage container 100 is depicted comprising a container body 110, a removable bottom closure component 120, and a lid 130. Container body 110 of example embodiment 400 comprises a beverage holding chamber 210 and a straw storage compartment 220. In example embodiment 400, straw-holding structure 270 is attached to an inner portion of the removable bottom closure component 120. In various embodiments, beverage container 100 may include a straw-holding structure 270 configured to secure a removable drinking straw (e.g., removable drinking straw 230) within straw storage compartment 220.

Referring back to FIG. 2, open upper end 260 of beverage holding chamber 210 may comprise an opening through which liquid in beverage holding chamber 210 may be accessed by a user. In various embodiments, lid 130 may be configured to engage container body 110 via open upper end 260 and temporarily enclose beverage holding chamber 210. In a closed position (i.e., when lid 130 is fully engaged with the container body at the open upper end of beverage holding chamber 210), lid 130 may be configured to seal beverage holding chamber 210. In an open position, lid 130 may comprise one or more openings through which liquid in beverage holding chamber 210 may be accessed by a user. For example, the one or more openings may comprise an opening configured to enable direct access to the liquid by a user and/or a straw opening configured to receive the removable drinking straw 230. In various embodiments, lid 130 may comprise a straw opening with a diameter no smaller than an outer diameter of removable drinking straw 230. In various embodiments, lid 130 may comprise at least one additional opening configured to equalize pressure within beverage holding chamber 210 when liquid is dispensed through another opening. In some embodiments, an opening configured to equalize pressure within beverage holding chamber 210 may be integral with an opening configured to enable access to the liquid by a user. For example, a single opening configured to enable direct access to the liquid by a user and/or receive removable drinking straw 230 may also be configured to equalize pressure within beverage holding chamber 210 when liquid is dispensed. In some embodiments, lid 130 may comprise a raised edge configured to prevent spillage of liquid when liquid is dispensed through an opening of lid 130.

Figure 5:
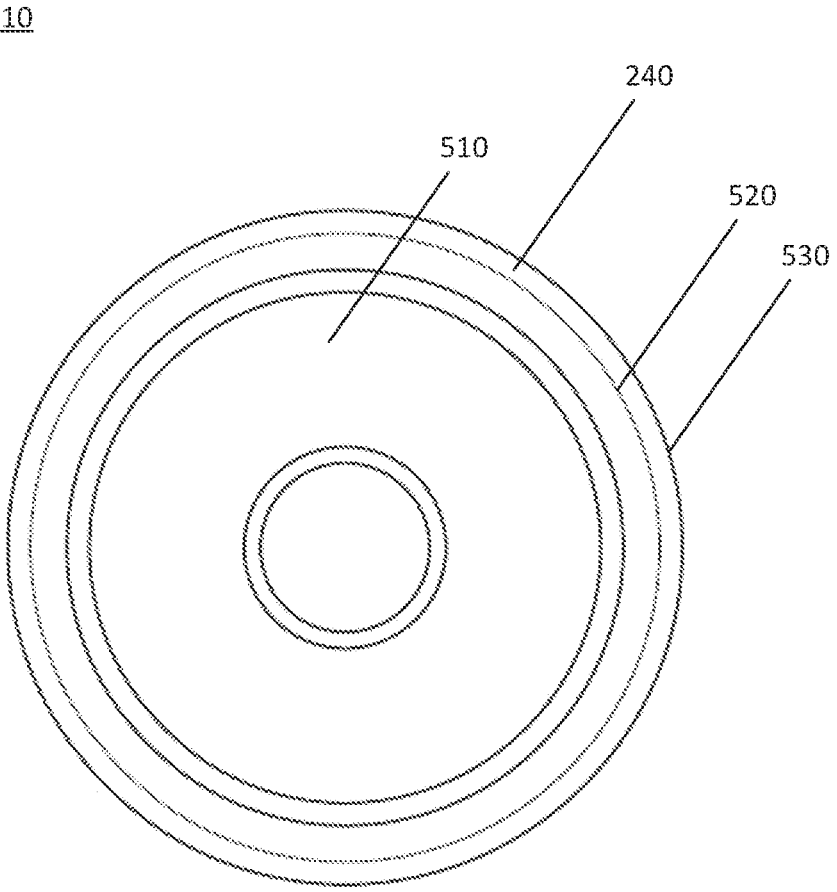
FIG. 5 shows a top view of a container body of a beverage container with a straw storage compartment, according to an implementation of the invention.
Figure 6:
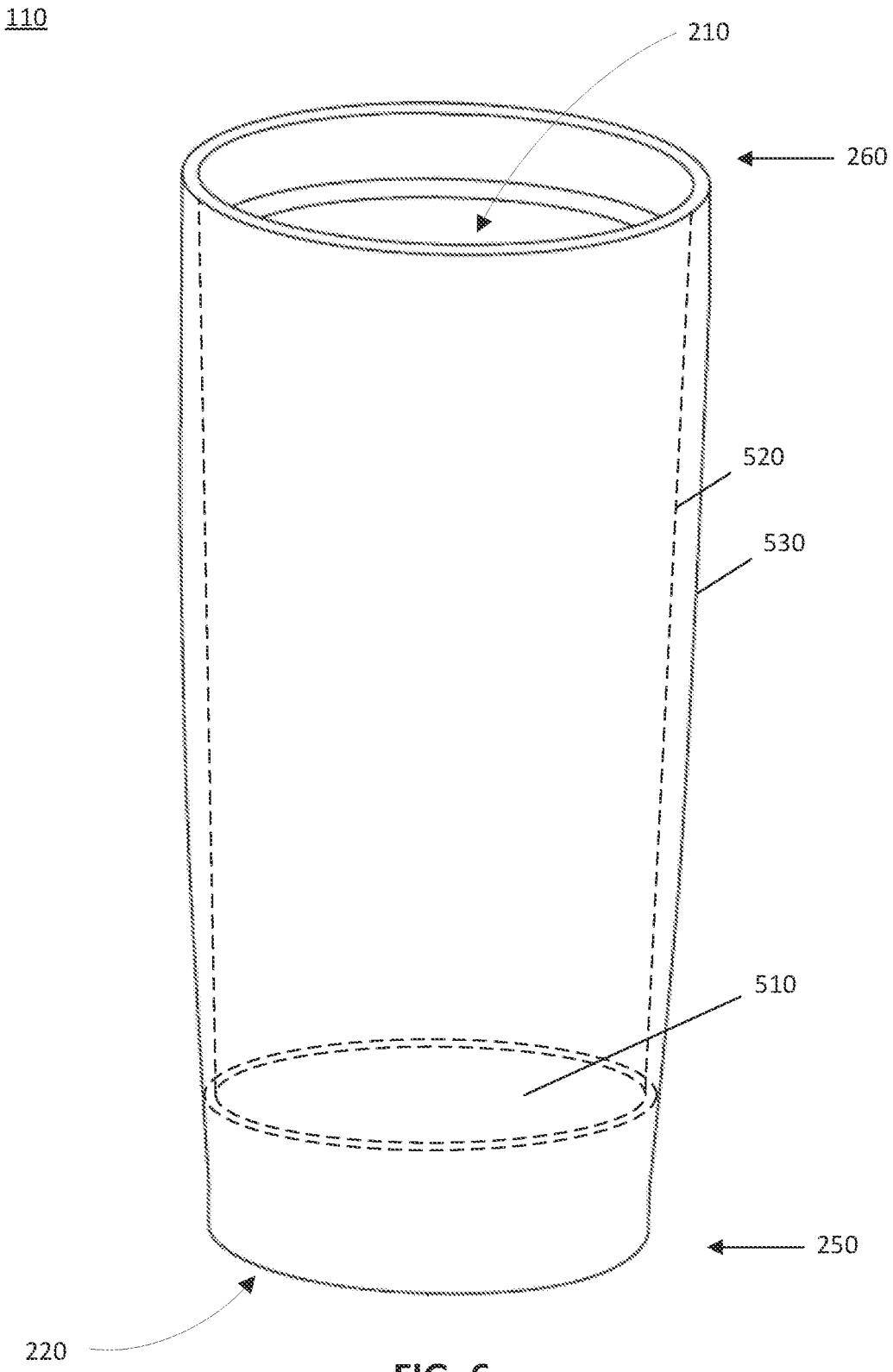
FIG. 6 shows a cross-sectional view of a container body of a beverage container with a straw storage compartment, according to an implementation of the invention.

FIG. 5 shows a top view of container body 110 of beverage container 100, according to an implementation of the invention. FIG. 6 shows a cross-sectional view of container body 110 with straw storage compartment 220, according to an implementation of the invention. Referring to FIG. 5 and FIG. 6 concurrently, container body 110 may comprise beverage holding chamber 210 for holding a liquid and a straw storage compartment 220. In various embodiments, beverage holding chamber 210 for holding a liquid may be defined by open upper end 260, outer container wall 240, and a closed lower end 510. In various embodiments, outer container wall 240 may be integral with closed lower end 510. In various embodiments, outer container wall 240 may comprise a double wall, vacuum insulated construction. For example, outer container wall 240 may comprise an interior wall 520 and an exterior wall 530 separated by a gap having at least a partial vacuum therein. Interior wall 520 may define the sides of beverage holding chamber 210.

In various embodiments, container body 110 may comprise an internal divider configured to physically separate beverage holding chamber 210 and straw storage compartment 220. The internal divider of container body 110 may define closed lower end 510 of beverage holding chamber 210 and a closed upper end of straw storage compartment 220. In various embodiments, the internal divider of container body 110 may be integral with container wall 240. In some embodiments, the internal divider of container body 110 may comprise a double wall, vacuum insulated construction. For example, the internal divider of container body 110 may comprise an upper wall defining the closed lower end of beverage holding chamber 210 and a lower wall defining closed upper end of straw storage compartment 220. In some embodiments, the upper wall and lower wall of the internal divider may be separated by a gap having at least a partial vacuum therein.

Figure 7:
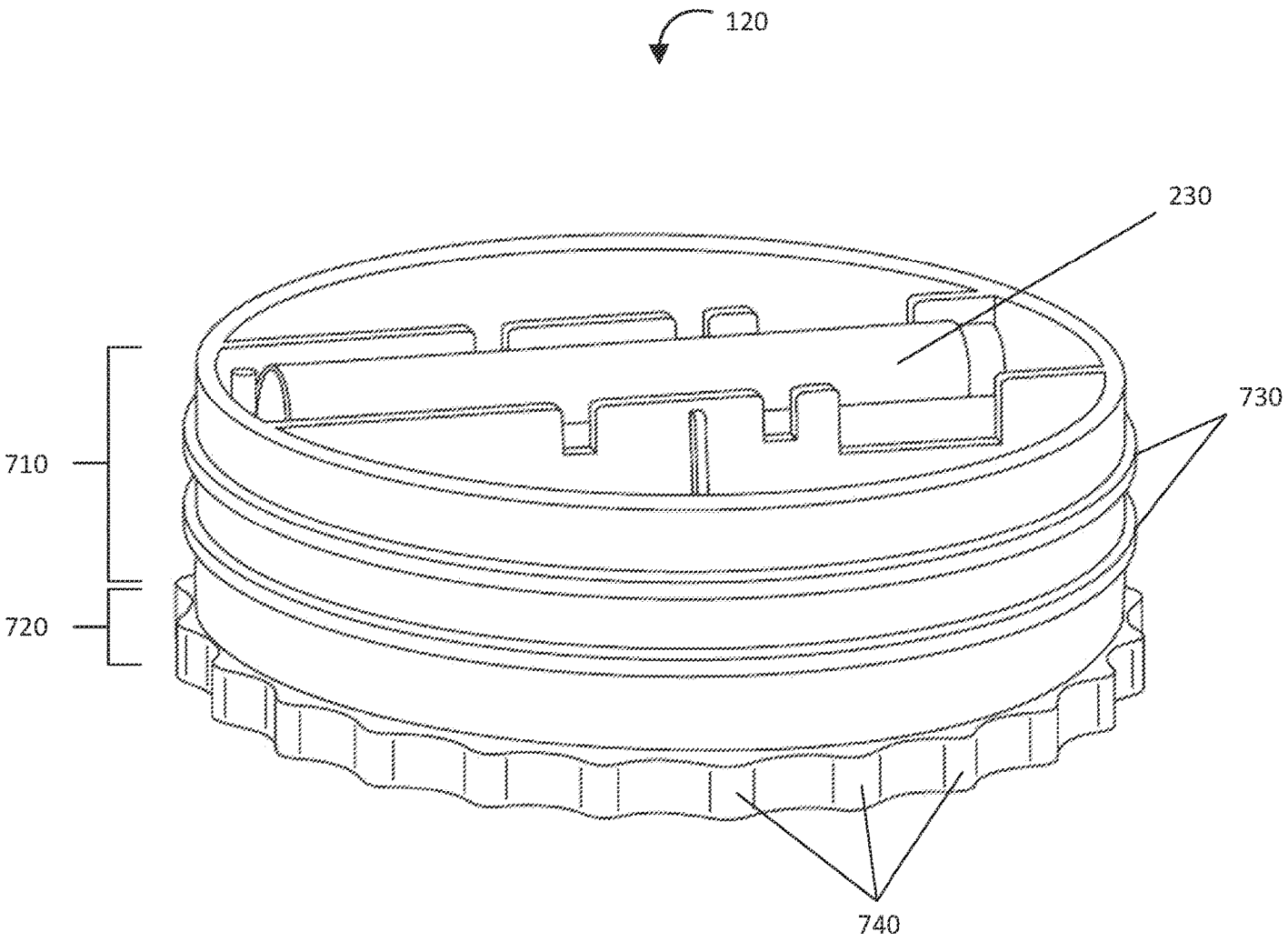
FIG. 7 shows a perspective view of a removable bottom closure component of a beverage container with a removable drinking straw, according to an implementation of the invention.

FIG. 7 shows a perspective view of removable bottom closure component 120 of beverage container 100, according to an implementation of the invention. In various embodiments, removable bottom closure component 120 may be configured to store removable driving straw 230. In various embodiments, removable bottom closure component 120 may be defined by an open top end, a closed bottom end, and an outer wall. When the removable bottom closure component 120 is fully engaged with container body 110 at open lower end 250 of the container body 110, the closed bottom end of removable bottom closure component 120 may comprise a base or bottom-facing side of beverage container 100. In various embodiments, the outer wall of removable bottom closure component 120 may comprise a first portion 710 and a second portion 720. In various embodiments, the first portion 710 of the outer wall of removable bottom closure component 120 may be integral with the second portion 720 of the outer wall of removable bottom closure component 120.

In various embodiments, the first portion 710 of the outer wall of removable bottom closure component 120 may be configured to fit within straw storage compartment 220 of container body 110. Accordingly, the first portion 710 of the outer wall of removable bottom closure component 120 may have a diameter smaller than a diameter of straw storage compartment 220 at open lower end 250. In various embodiments, the first portion 710 of the outer wall of removable bottom closure component 120 may be configured to engage open lower end 250 of straw storage compartment 220. In various embodiments, the first portion 710 of the outer wall of removable bottom closure component 120 may comprise screw threads 730 configured to engage screw threads on an inner side wall of straw storage compartment 220. When first portion 710 is fully engaged with open lower end 250, the first portion 710 of the outer wall of removable bottom closure component 120 may be fully enclosed within straw storage compartment 220.

In various embodiments, the outer wall of removable bottom closure component 120 may comprise a second portion 720 having a diameter different from the diameter of first portion 710. In various embodiments, second portion 720 may have a diameter greater than the diameter of first portion 710. When the removable bottom closure component 120 is fully engaged with container body 110 at open lower end 250 of the container body 110, second portion 720 may form an exposed lip extending below outer container wall 240. Accordingly, the second portion 720 of the outer wall of removable bottom closure component 120 may have a diameter greater than the diameter of the open lower end 250 of container body 110. In various embodiments, the second portion 720 of the outer wall of removable bottom closure component 120 may comprise ridges 740 configured to facilitate engagement with removable bottom closure component 120 by a user. For example, ridges 740 may be spaced at periodic intervals and configured assist a user in gripping and removing removable bottom closure component 120 when removable bottom closure component 120 is fully engaged with container body 110 at open lower end 250.

Figure 8:
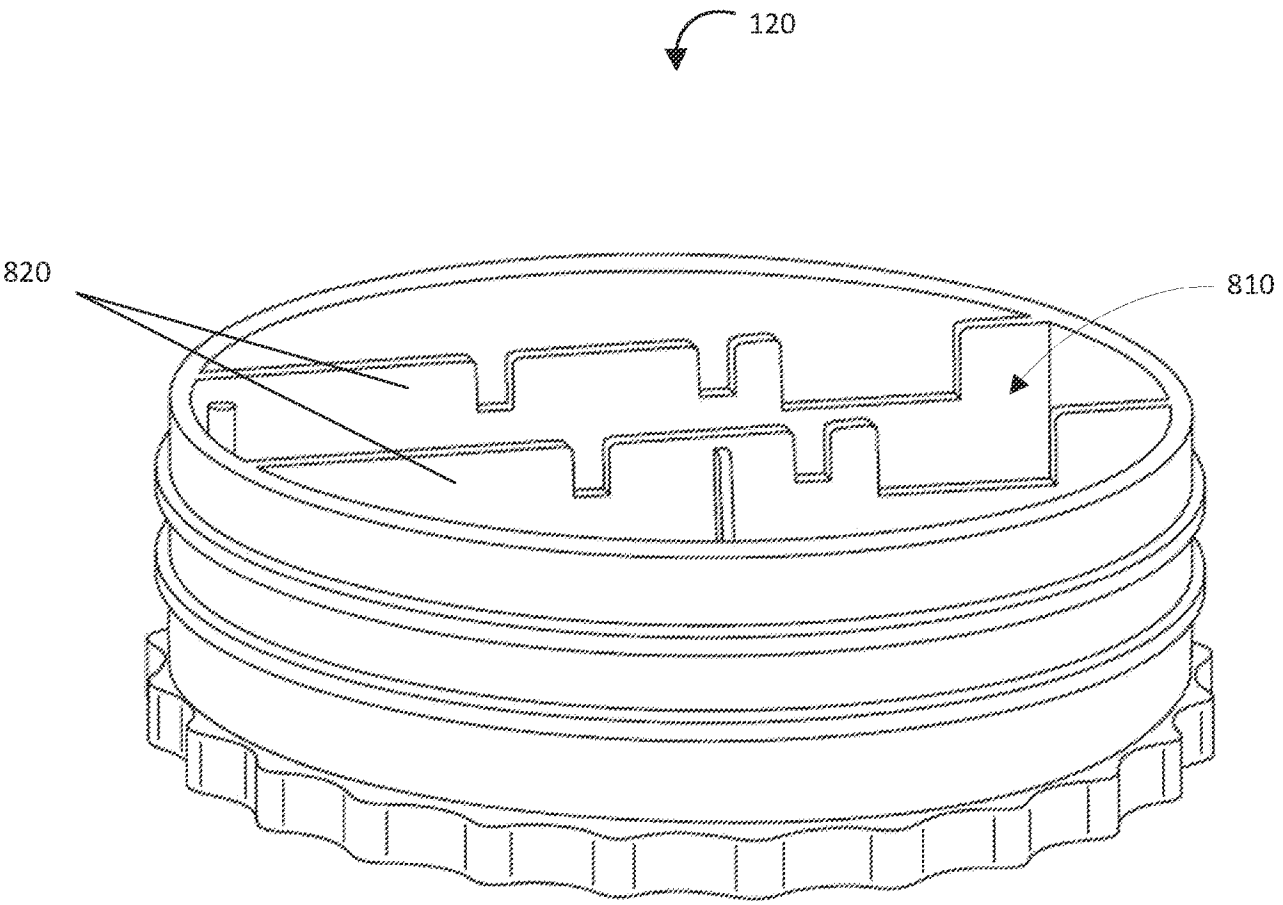
FIG. 8 shows a perspective view of a removable bottom closure component with a straw-holding structure, according to an implementation of the invention.
Figure 9:
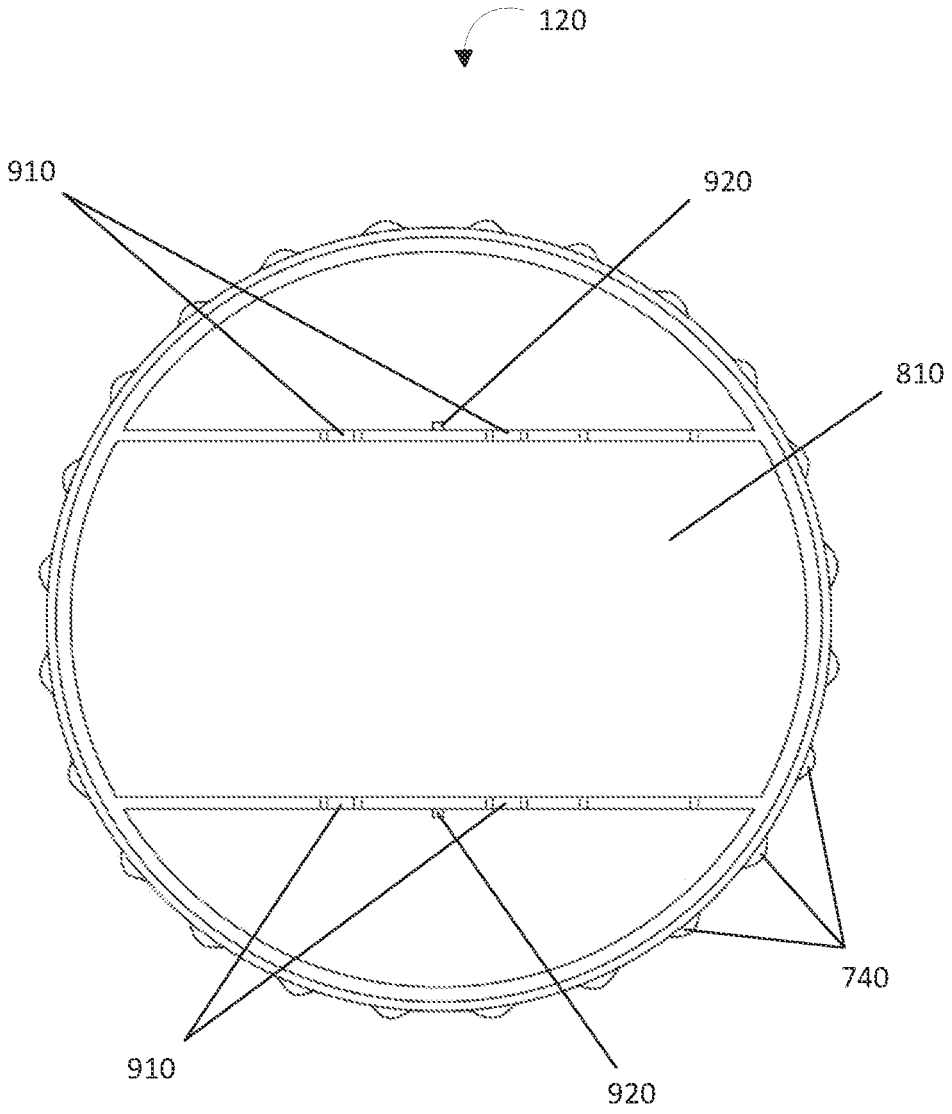
FIG. 9 shows a top view of a removable bottom closure component with a straw-holding structure, according to an implementation of the invention.

FIG. 8 shows a perspective view of removable bottom closure component 120 of beverage container 100 with a straw-holding structure, according to an implementation of the invention. FIG. 9 shows a top view of removable bottom closure component 120 as depicted in at least FIG. 8, according to an implementation of the invention. Referring to FIG. 8 and FIG. 9 concurrently, removable bottom closure component 120 of beverage container 100 may include a straw-holding structure the same as or similar to straw-holding structure 270. In various embodiments, removable bottom closure component 120 may comprise a channel 810 and multiple interior walls 820. In some embodiments, the multiple interior walls 820 may define channel 810. In some embodiments, channel 810 and multiple interior walls 820 may together form a straw-holding structure configured to receive a straw (e.g., removable drinking straw 230) and hold the straw in a relatively fixed position within removable bottom closure component 120, or within straw storage compartment 220 when removable bottom closure component 120 is affixed to container body 110. In various embodiments, the multiple interior walls 820 may be integral with the outer wall of removable bottom closure component 120. In various embodiments, the multiple interior walls 820 may be configured to secure a removable drinking straw (e.g., removable drinking straw 230) within straw storage compartment 810 of removable bottom closure component 120.

In various embodiments, the multiple interior walls 820 may comprise one or more cutouts 910, one or more protrusions 920, and/or other features. The one or more cutouts 910 may be configured to facilitate access to a removable drinking straw stored within straw storage compartment 810 (i.e., enable a removable drinking straw stored within straw storage compartment 810 to be removed more easily by a user), facilitate insertion of a removable drinking straw in straw storage compartment 810 (i.e., enable a removable drinking straw to be inserted within straw storage compartment 810 more easily by a user), facilitate secure storage of a removable drinking straw within straw storage compartment 810 (i.e., cause a removable drinking straw to be more securely stored within straw storage compartment 810), and/or otherwise facilitate access or storage of a removable drinking straw within straw storage compartment 810. The one or more protrusions 920 may be configured to facilitate secure storage of a removable drinking straw within straw storage compartment 810 (i.e., cause a removable drinking straw to be more securely stored within straw storage compartment 810).

In various embodiments, removable bottom closure component 120 may be configured to store a removable drinking straw (e.g., removable drinking straw 230) and/or one or more other items. Accordingly, the beverage container with a storage compartment for a self-contained straw described herein may similarly be configured to store one or more other items within the storage compartment along with and/or instead of a self-contained straw. Similarly, the beverage container described herein may be configured to store one or more types of straws. In various embodiments, removable drinking straw 230 may comprise a reusable drinking, a non-reusable/disposable drinking straw, and/or one or more other types of drinking straws. In various embodiments, removable drinking straw 230 may comprise a collapsible straw. For example, removable drinking straw 230 may comprise one or more bendable and/or extendable parts with bellows folds. In various embodiments, removable drinking straw 230 may comprise any type of drinking straw configured and/or capable of being stored within the storage compartment formed by straw storage compartment 220 of container body 110 and removable bottom closure component 120 when removable bottom closure component 120 is affixed to container body 110.

While the disclosure has been described in terms of example embodiments, those skilled in the art will recognize that the disclosure can be practiced with modifications in the spirit and scope of the appended claims. These examples given above are merely illustrative and are not meant to be an exhaustive list of all possible designs, embodiments, applications or modifications of the disclosure.

What is claimed is:

1. A beverage container comprising:

a container body having a container wall, a beverage holding chamber for holding a liquid having an open upper end and a closed lower end, and a straw storage compartment having a closed upper end and an open lower end, wherein an interior divider of the container body integral with the container wall defines the closed lower end of the beverage holding chamber and the closed upper end of the straw storage compartment; and a removable bottom closure component configured to engage the container body at the open lower end of the straw storage compartment and temporarily enclose the straw storage compartment, wherein the removable bottom closure component comprises an outer wall having a first portion and a second portion, wherein the first portion is configured to engage the open lower end of the straw storage compartment, wherein the second portion extends below the container wall when the removable bottom closure component is fully engaged with the container body at the open lower end of the straw storage compartment, wherein an outer diameter of the second portion is greater than an outer diameter of the open lower end of the straw storage compartment, and wherein a removable drinking straw is entirely enclosed within the straw storage compartment when the removable bottom closure component is fully engaged with the container body at the open lower end of the straw storage compartment.

2. The beverage container of claim 1, wherein the beverage container further comprises:

a lid configured to engage the container body at the open upper end of the beverage holding chamber and temporarily enclose the beverage holding chamber.

3. The beverage container of claim 1, wherein the removable bottom closure component further comprises a straw-holding structure configured to secure the removable drinking straw within the removable bottom closure component.

4. The beverage container of claim 1, wherein the straw storage compartment further comprises a straw-holding structure configured to secure the removable drinking straw within the straw storage compartment.

5. The beverage container of claim 1, wherein the beverage container further comprises a straw-holding structure, the straw-holding structure comprising one or more channels configured to receive the removable drinking straw and hold the removable drinking straw in a relatively fixed position within the straw storage compartment.

6. The beverage container of claim 5, wherein the one or more channels are configured to receive and hold the removable drinking straw, the removable drinking straw having one or more bends.

7. The beverage container of claim 6, wherein the one or more channels include one or more protrusions configured to retain the removable drinking straw within the channel.

8. The beverage container of claim 1, wherein the interior divider physically separates the beverage holding chamber from the straw storage compartment.

9. The beverage container of claim 1, wherein the first portion of the outer wall is configured to engage the open lower end of the straw storage compartment, wherein the first portion of the outer wall is enclosed within the straw storage compartment when the removable bottom closure component is fully engaged with the container body at the open lower end of the straw storage compartment.

10. The beverage container of claim 9, wherein the first portion of the outer wall comprises screw threads configured to engage screw threads on an inner wall of the straw storage compartment.

11. The beverage container of claim 9, wherein the second portion of the outer wall is integral with the first portion, and wherein an outer diameter of the second portion is greater than an outer diameter of the first portion.

12. The beverage container of claim 11, wherein the second portion of the outer wall has a ridged outer surface.

13. The beverage container of claim 1, wherein the container wall comprises an interior wall and an exterior wall separated by a gap having at least a partial vacuum therein.

14. The beverage container of claim 13, wherein interior divider comprises an upper wall and a lower wall separated by a gap having at least a partial vacuum therein.

15. The beverage container of claim 1, wherein the open upper end of the beverage holding chamber comprises an opening through which the liquid is accessed by a user.

16. The beverage container of claim 2, wherein the lid seals the beverage holding chamber opening in a closed position.

17. The beverage container of claim 2, wherein in an open position the lid comprises a straw opening configured to receive the removable straw, wherein a diameter of the straw opening is no smaller than an outer diameter of the removable straw.

18. The beverage container of claim 2, wherein in an open position the lid comprises a first opening through which the liquid is accessed by a user.

19. The beverage container of claim 18, wherein in an open position the lid further comprises a second opening configured to equalize pressure within the beverage holding chamber when the liquid is dispensed through the first opening.

20. The beverage container of claim 19, wherein the second opening is integral with the first opening.

* * * * *